US005314383A

United States Patent [19]

Fabbri

[11] Patent Number: 5,314,383

[45] Date of Patent: May 24, 1994

[54] ROCKING SHIP FUNFAIR RIDE

[75] Inventor: Licinio Fabbri, Bergantino, Italy

[73] Assignee: Far Fabbri S.r.L., Bergantino, Italy

[21] Appl. No.: 5,124

[22] Filed: Jan. 15, 1993

[30] Foreign Application Priority Data

Jan. 29, 1992 [IT] Italy ..... M092 A 000010

[51] Int. Cl.[5] ..... A63G 1/08; A63G 31/16

[52] U.S. Cl. ..... 472/45; 472/3

[58] Field of Search ..... 472/3, 44, 30, 45, 46, 472/39, 42

[56] References Cited

U.S. PATENT DOCUMENTS

| | | | |
|---|---|---|---|
| 2,158,073 | 5/1939 | Keith et al. | 472/30 |
| 3,612,517 | 10/1971 | Schwarzkopf | 472/3 |
| 4,339,121 | 7/1982 | Schwarzkopf | 472/45 |
| 4,643,416 | 2/1987 | van der Veen | 472/3 |
| 5,188,566 | 2/1993 | Böhme | 472/3 |

FOREIGN PATENT DOCUMENTS

0433557A1 6/1991 European Pat. Off. .

*Primary Examiner*—Carl D. Friedman
*Assistant Examiner*—Kien Nguyen
*Attorney, Agent, or Firm*—Mason, Fenwick & Lawrence

[57] ABSTRACT

The invention relates to an improvement in a funfair ride and in particular one which comprises a rocking ship. The ride, of the type mounted on the plane (1*a*) of a transportable carriage (1) comprises a pair of telescopic uprights (2) to which a frame is connected, the frame comprising a shaft (3) and a pair of levers (4) having equal arms, which frame rotates about the axis of the shaft (3) and which bears a ship (5) connected to the levers and in its turn rotating about an axis parallel to the shaft (3); the height of the uprights (2), their extension, the length of the arms of the levers (4) and the maximum height of the ship (5) have a size conformation and relationship such as to permit of compacting the ride into transportable dimensions, without disconnecting among themselves the various pieces that compose the ride.

3 Claims, 2 Drawing Sheets

ROCKING SHIP FUNFAIR RIDE

BACKGROUND OF THE INVENTION

The invention relates to an improved funfair ride, consisting of a rocking ship.

The prior art embraces a special type of funfair ride, comprising a pair of uprights to which a frame is connected, the frame being constituted by a shaft and a pair of levers of the first kind, with equal arms, which levers are arranged parallel between themselves, perpendicularly to the shaft and solidly connected to the shaft at their fulcrum; substantially, the frame is "H"-shaped. This H-frame is set in rotation by means of motor means that can be of various types.

The ride further comprises a ship, developing longitudinally, equipped with seats, which is arranged parallel to the shaft and has its lateral ends hinged each to an end of one of the levers in such a way as to be arranged all in one same semispace with respect to its hinge axis and in such a way also as to rotate freely about the said axis. A brake is also envisaged which can prevent, on command, the free rotation of the ship about its axis.

During the rotation of the frame, the ship, which would tend, due to gravity, to remain downwards-turned with the seated passengers "heads-up", is successively blocked and released in such a way as to perform rotations about its hinge axis, which cause the passengers to assume different positions with respect to those which they would tend to assume through force of gravity, if the ship were not braked. The sensation which the ride gives to the passengers is that resulting from these sequences of movements and anomalous positions, with respect to those assumed due to gravity.

This type of ride, which like almost all rides is mounted on a carriage so that it can be transported, has an important drawback. In order to be transported the ride, owing to its considerable mass when in working configuration, must be dismounted so as to make its size compatible with the maximum dimensions permitted for travelling vehicles.

In particular, it is necessary to remove the frame shaft, detach the ship and fold the uprights, leaving the levers connected to them, so as the said levers can be laid on the carriage. It is also necessary to use a second carriage for the transport of the shaft and the ship.

Apart from the long dismounting operation, which must be performed with the help of a crane of considerable size, these rides also need, for their transport, a further carriage apart from the one used as a support structure during the operation of the ride itself.

An aim of the present invention is that of eliminating the above-mentioned drawbacks by providing a ride, of the type described, which can be put into transport position without the necessity of performing dismounting operations to its parts and which can be transported using only the carriage destined to function as a support structure during the functioning of the ride itself.

An advantage offered by the ride with respect to known rides is that of permitting the passengers a rapid and easy ascent and descent.

A further advantage of the ride in object is that of exhibiting very small flexional deformations of the ship, which leads to a drastic reduction in the forces on the arms of the levers.

SUMMARY OF THE INVENTION

These aims and advantages and more besides are all attained by the funfair ride object of the present invention, as it is characterised in the claims that follow, which is of the type mounted on the plane of a transportable carriage and comprises a pair of uprights to which a frame is connected, comprising a shaft and a pair of levers having equal arms, which frame rotates about the axis of the shaft and which bears a ship connected to the levers and in its turn rotating about an axis parallel to the shaft, and is characterised in that: the uprights are of the telescopic type; the arms which do not bear the ship are equipped with hinges and are foldable; the maximum height of the ship is less than the length of an arm of the levers; the minimum height of the uprights is greater than the sum of the length of an arm of a lever and the maximum height of the ship.

BRIEF DESCRIPTION OF THE DRAWINGS

Further characteristics and advantages of the present invention will better emerge from the detailed description that follows, of an embodiment of the invention, herein illustrated purely in the form of a non-limiting example in the accompanying figures, in which.

DESCRIPTION OF THE PREFERRED EMBODIMENTS

Figure 2:
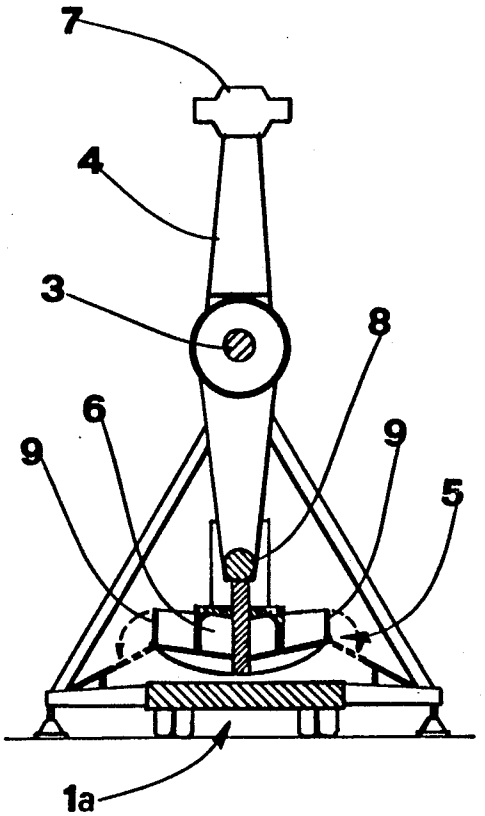
FIG. 2 shows a schematic section, made according to plane II—II of FIG. 1, of the ride in working position.
Figure 1:
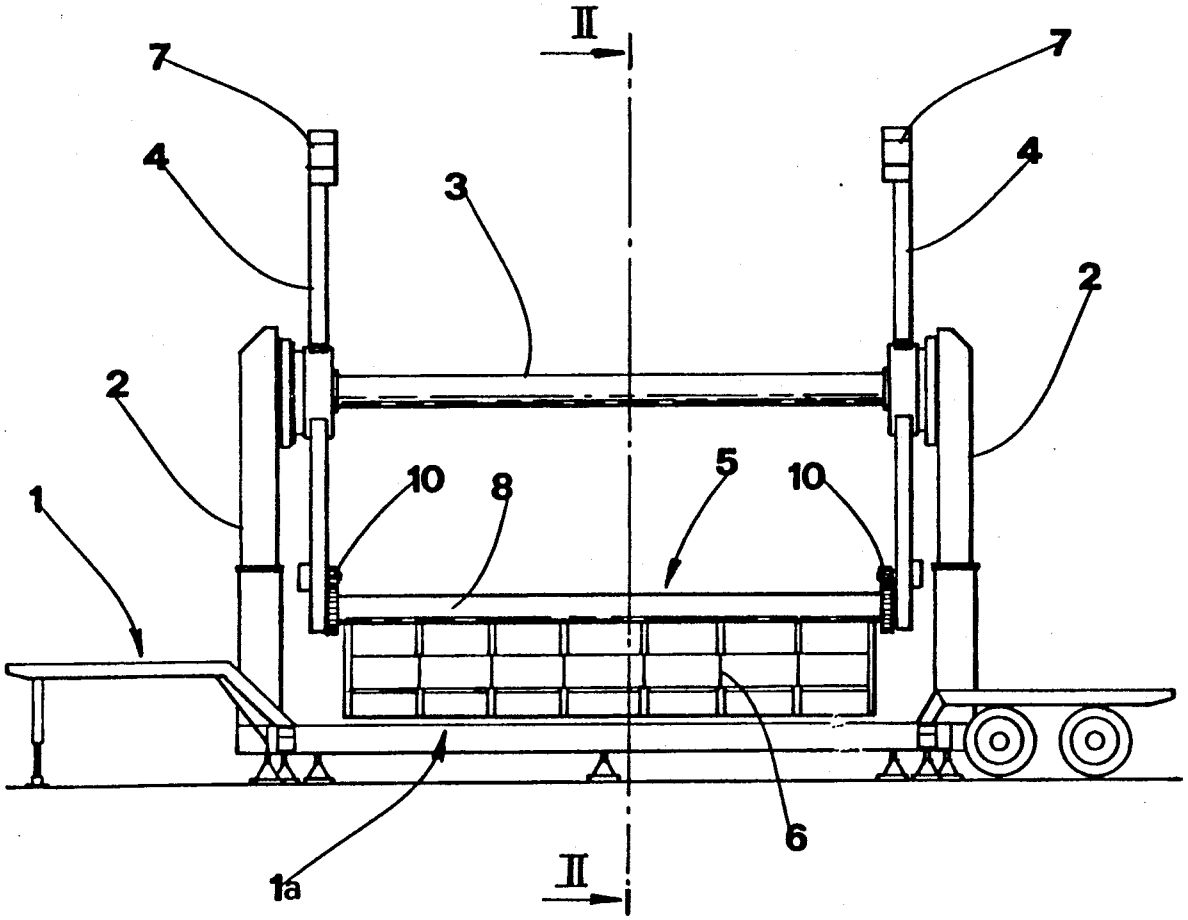
FIG. 1 shows a schematic vertical-elevation view of the ride in working position.

The ride object of the present invention is mounted on the plane of a transportable carriage 1 from which a pair of uprights 2 of the telescopic type project.

At the upper ends of the uprights 2 an H-frame is mounted, comprising a shaft 3, perpendicular to the uprights 2, and a pair of levers 4 of the first kind with equal arms, equal and parallel to each other, each of which is connected at its fulcrum internally to the uprights 2 to an end of the shaft 3, and perpendicular and solid to the shaft 3.

Motor means are envisaged, not indicated in the figure and in any case of known type, which set the said frame in rotation about the axis of the shaft 3.

The ride further comprises a ship 5 developing longitudinally, which is equipped with a plurality of seats 6 on which the ride-users sit during the functioning of the ride. The ship 5 is arranged 10 parallel to the shaft 3 and comprises a longitudinal bar 8 which lateral ends are hinged each to an end of one of the levers; the longitudinal bar 8 is arranged in such a way that the ship 5 is arranged all in one same semispace with respect to the longitudinal bar 8 itself. The ship 5 can freely rotate about the axis of the longitudinal bar 8.

The seats 6 of the ship 5 are arranged in two longitudinal lines anteriorly to which two lateral longitudinal railings 9 are arranged, which latter are inferiorly hinged in such a way as to be able to be rotated towards the outside of the ship 5.

Counterweights 7 are connected to the free ends of the levers 4, which lever free ends are those opposite to the ones the ship 5 is connected to. The free arms are equipped with transversal hinges, arranged in proximity to the fulcrum of the respective lever 4, so as to be rotatable, in the transport phase, with respect to the remaining part of the respective lever and be folded internally to the uprights 2 and parallel to the shaft 3.

With the aim of preventing the free rotation of the ship 5 about the axis of the longitudinal bar 8, and thus obtaining the above-mentioned special movements of the ship 5 during the rotation of the H-frame, a brake is envisaged, just as in known-type rides. This brake comprises two cogwheel-pinion 10 pairs, each of which is arranged at one end of the longitudinal bar 8. The cogwheels are solid in rotation with the longitudinal bar 8, while the pinions can be blocked by means of a reducing gear device which reduces the force necessary to stop the rotation of the pinions and thus the longitudinal bar 8 and the ship 5.

For reasons that will become more evident hereinafter, the maximum height of the ship 5 is less than the length of an arm of the levers 4; it is further envisaged that the minimum height, with respect to the plane 1*a*, of the uprights 2 when the said uprights 2 are totally retracted, is greater than the length of an arm of the said levers 4; finally, the maximum height of the uprights 2 is greater than the sum of the length of an arm of a lever 4 and the maximum height of the ship 5.

It should be noted that the above-mentioned masses refer to the hinge axes of the various pieces, and do not take into account the dimensions of the shafts and the rotation pivots; those will have to be taken into account during the construction phase.

In relation to the above-mentioned heights, the reference to the plane 1*a* should be taken as height zero and the measurements started from there; it is obvious that if the ride were to be placed on the ground, then the ground would be taken to represent the plane; in cases where the plane is not a flat surface, as a reference-point zero it would be necessary to consider the horizontal plane tangential to the inferior point of the said non-flat surface.

The functioning of the ride is similar to those of known type, even if it exhibits certain advantages: first of all, the special arrangement of the seats 6 and the presence of the externally-rotatable railings permit contemporaneous access to all of the seats, which is not possible in the rides of known type; secondly, the presence of the longitudinal bar 8 prevents flexional deformations of the ship 5 and does not impose a flexion on the arms of the levers 4, which happens in known-type rides in which the levers 4 must be articulated, with obvious complications and increases in construction costs, with the aim of avoiding their deformation or breakage following the forces generated by the flexion of the ship 5.

It is well to underline that the ship 5 constructed as described above would offer the same advantages even if applied to rides of known type.

It should also be noted that with the above-mentioned proportions among the various elements, the maximum height of the uprights 2 is greater than the maximum downwards-length of the rotating part of the ride (given by the length of an arm plus the maximum height of the ship); thus no danger exists of interference between the ship 5 and the plane 1*a* of the carriage.

When the ride must be transported the following operations are carried out. Minor operations, such as the closure of the access steps, the entrance rails and the support rods, are not mentioned herein since they present no difficulty and are relative to elements which present no mass problem.

The ship 5, free to rotate, is brought into the upper position, and, by force of gravity, becomes disposed in a downwards direction (that is, all of it comprised between the longitudinal bar 8 and the shaft 3); in this position the ship 5 is blocked by acting on the cogwheel-pinion 10. The ship 5 does not interfere with the shaft 3 since its height is less than the length of the arm of the lever 4.

The frame is thus rotated by 90 degrees and in this position the upper arms are folded internally.

It should be noted that, in cases where the height of the ship 5 requires it, it is possible to move the shaft 3 in an opposite direction to the ship 5 and parallel to the rotation axis of the H-frame; that permits of obtaining a greater space for the housing of the ship 5 in transport position. This movement must however be such as not to prevent the folding of the upper arms (it must not, that is, bring the shaft 3 into a position above the hinges of the upper arms).

Figure 4:
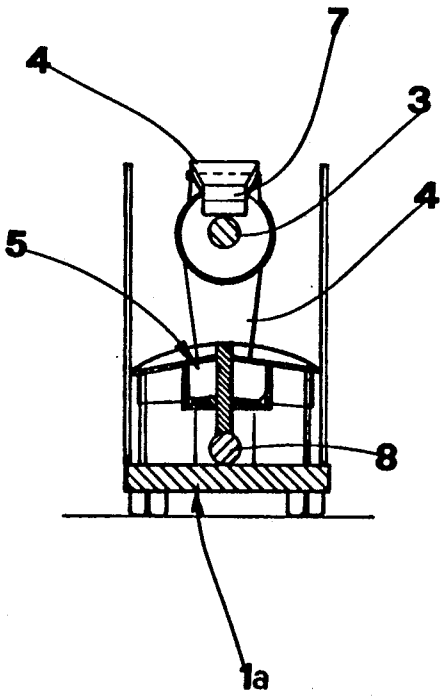
FIG. 4 shows a schematic section, made along plane IV—IV of FIG. 3, of the ride in transport position.
Figure 3:
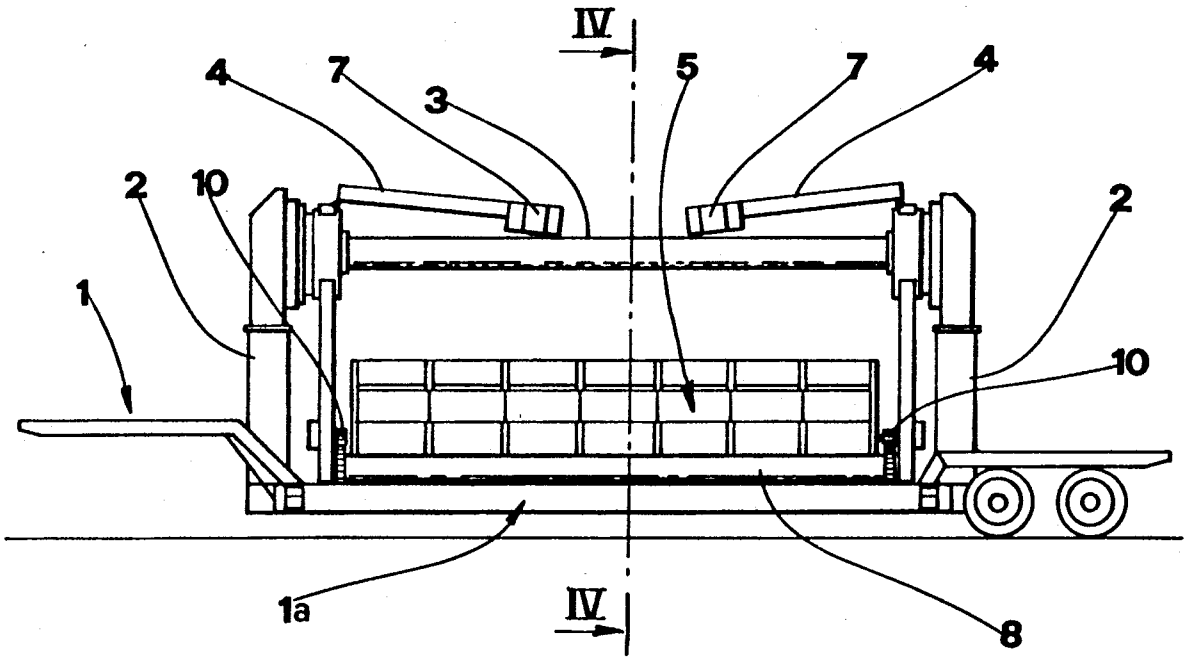
FIG. 3 shows a schematic vertical-elevation view of the ride in transport position.

The frame, with the ship 5 blocked, is made to rotate by another 90 degrees and the uprights are retracted up to their minimum height; in this position, illustrated in FIGS. 3 and 4, there is no interference with the plane 1*a* since the ship 5 is comprised within the vertical height of the arms and the arms are shorter than the minimum height of the uprights 2.

In order to guarantee the blocking of the ship 5, preferably a stop rod is inserted which blocks the ship 5, independently of the action of the brake, in the above-described position.

At this point the ride is ready to be transported on a single carriage which is the same that serves as a rest plane during functioning. It should be noted that all of the operations described can be effected without the help of an auxiliary machine, such as a crane or similar, and without any operator having to climb on the structure of the ride, as happens in the prior art rides.

It should also be observed that, again with respect to the proportions indicated among the various elements, the minimum height of the uprights 2, and thus the dimensions of the other elements, such as the length of the ride, will be determined, as happens with all transportable rides, by the maximum dimensions permitted by the law for the movement of vehicles.

Finally it must be underlined that the above-described funfair ride could also be realised with arms bearing counterweights foldable towards the outside or even dismountable. These two solutions, however, even if advantageous with respect to the prior art rides, would present smaller advantages with respect to the indicated solution.

What is claimed is:

1. An improved "rocking ship" funfair ride of the type mountable on a plane of a carriage and comprising:

a pair of parallel, telescopic, upright members, each having an upper end, a lower end, an inner side, an outer side, and an adjustable height;

a pair of parallel levers, each having two arms of equal length projecting in opposite directions from a fulcrum, each of said arms having an outer end distant from said fulcrum and an inner end adjacent said fulcrum;

a shaft rigidly connected to, and extending between said lever fulcrums, said shaft having a central axis and being perpendicular to said levers and holding said levers in spaced, parallel relationship to each other, and said shaft being rotatably mounted to the upper ends of said upright members;

motor means for rotating said levers and said shaft about said central axis of said shaft;

a ship arranged parallel to said shift, and having a plurality of seats, two lateral ends, and a predetermined height, with said lateral ends being rotatably connected at two points defining a ship rotation axis to the respective outer ends of two of said lever arms on a same side of said lever fulcrums; and brake means for controlling rotation of said ship; wherein the two lever arms opposite to the lever arms connected to the ship are hinged at the respective inner ends and foldable inwardly from said upright members and parallel to said shaft; and a maximum height of said ship is less than the length of an arm of said levers, a minimum height of said upright members is greater than the length of an arm of said levers, and a maximum height of said upright members is greater than a sum of the length of an arm of said levers and said maximum height of said ship.

2. The ride of claim 1, wherein said ship comprises a bar, said bar extending along said ship rotating axis.

3. The ride of claim 1, wherein said seats are arranged in two rows parallel to said ship rotation axis, and further including two longitudinal rails parallel to said rows of seats and movable toward and away from said rows of seats along predetermined arcuate paths.

* * * * *